US008890504B2

(12) United States Patent
Fu et al.

(10) Patent No.: US 8,890,504 B2
(45) Date of Patent: Nov. 18, 2014

(54) POWER ADAPTER

(75) Inventors: Ying-Bin Fu, Shenzhen (CN); Yuan-Xi Chen, Shenzhen (CN); Ya-Jun Pan, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 242 days.

(21) Appl. No.: 13/531,096

(22) Filed: Jun. 22, 2012

(65) Prior Publication Data

US 2013/0107578 A1 May 2, 2013

(30) Foreign Application Priority Data

Oct. 26, 2011 (CN) ..... 2011 1 0329447

(51) Int. Cl.
*G05F 1/613* (2006.01)
*G05F 1/618* (2006.01)

(52) U.S. Cl.
CPC ..... *G05F 1/618* (2013.01)
USPC ..... 323/298; 323/226; 307/103

(58) Field of Classification Search
CPC ..... G05F 1/613; H02M 2001/0025
USPC ..... 323/226, 273, 275, 298; 307/103
See application file for complete search history.

(56) References Cited

U.S. PATENT DOCUMENTS 7,795,852 B2 * 9/2010 Zeng et al. ..... 323/282
8,723,596 B2 5/2014 Chi et al.
2011/0074495 A1 * 3/2011 Duval et al. ..... 327/539

FOREIGN PATENT DOCUMENTS

CN 102035410 A 4/2011

OTHER PUBLICATIONS

"Design of constant current power based on FET", Junjie Tian, China Measurement & Test, vol. 35 No. 1, pp. 118-121, Jan. 2009, China.

* cited by examiner

*Primary Examiner* — Harry Behm
*Assistant Examiner* — Matthew Grubb
(74) *Attorney, Agent, or Firm* — Novak Druce Connolly Bove + Quigg LLP

(57) ABSTRACT

A power adapter includes a processing circuit converting mains power to another alternating current (AC) power or a direct current (DC) power, a first output outputting the converted AC or DC power, a sense resistor connected between the processing circuit and the first output for sampling current flowing through the first output and converting the sampled current to a sampled voltage, an amplifying circuit connected to the sense resistor for amplifying the sampled voltage, and a metallic oxide semiconductor field effect transistor (MOSFET). A gate of the MOSFET is connected to the amplifying circuit. A drain of the MOSFET is connected to the first output through a first resistor and grounded through a second resistor. A source of the MOSFET is grounded. A node between the first and second resistors is connected to the processing circuit. The amplifying circuit makes the MOSFET work in a variable resistance region.

5 Claims, 1 Drawing Sheet

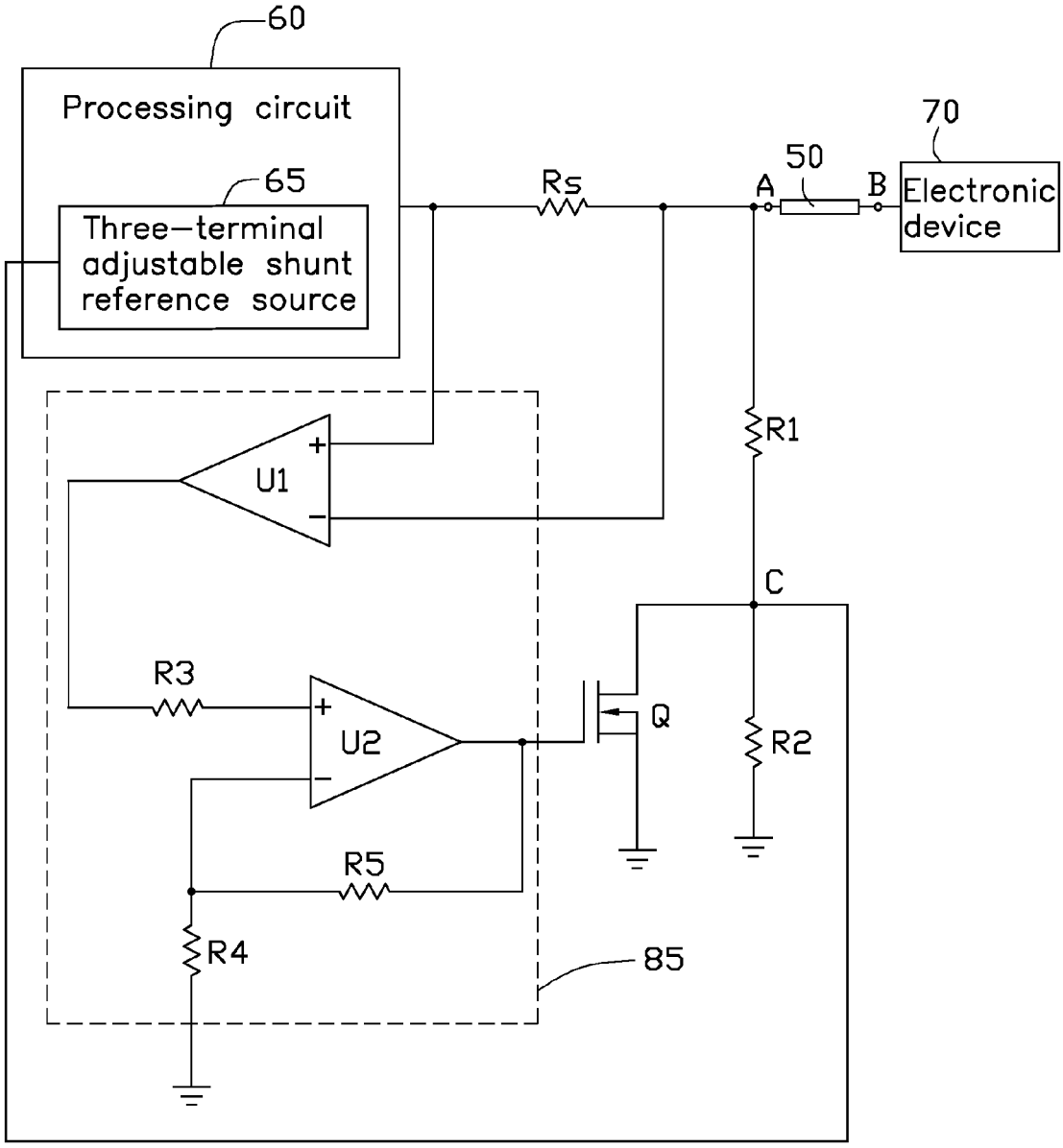
60
Processing circuit
65
Three-terminal adjustable shunt reference source
Rs
A
50
B
70
Electronic device
R1
U1
C
R3
U2
Q
R2
R5
R4
85

POWER ADAPTER

BACKGROUND

1. Technical Field

The present disclosure relates to a power adapter.

2. Description of Related Art

Power adapters provide power with a standard voltage for electronic devices. A power adapter may include a transmission line with a length of 1 meter or 1.5 meters. Impedance of the transmission line may cause the voltage at the electronic device to be less than the standard voltage. In addition, when the current flowing through the electronic device changes, the voltage at the electronic device changes. This is potentially damaging for the electronic device.

BRIEF DESCRIPTION OF THE DRAWING

Many aspects of the embodiments can be better understood with reference to the drawing. The components in the drawing are not necessarily drawn to scale, the emphasis instead being placed upon clearly illustrating the principles of the present embodiments.

The FIGURE is a circuit diagram of an exemplary embodiment of a power adapter.

DETAILED DESCRIPTION

The disclosure, including the accompanying drawing, is illustrated by way of examples and not by way of limitation. It should be noted that references to "an" or "one" embodiment in this disclosure are not necessarily to the same embodiment, and such references mean "at least one".

Referring to the FIGURE, an exemplary embodiment of a power adapter for supplying stable power to an electronic device 70 includes a processing circuit 60, an output A, an output B, a transmission line 50, a sense resistor Rs, an amplifying circuit 85, a metallic oxide semiconductor field effect transistor (MOSFET) Q, and resistors R1 and R2. The amplifying circuit 85 includes amplifiers U1 and U2, and resistors R3, R4, and R5.

The processing circuit 60 is connected to the output A through the sense resistor Rs. The transmission line 50 is connected between the output A and the output B. The output A is grounded through the resistors R1 and R2 connected in series. The output B is connected to the electronic device 70. The terminal of the sense resistor Rs connected to the processing circuit 60 is connected to a non-inverting terminal of the amplifier U1, and the terminal of the sense resistor Rs connected to the output A is connected to an inverting terminal of the amplifier U1. An output of the amplifier U1 is connected to a non-inverting terminal of the amplifier U2 through the resistor R3. An inverting terminal of the amplifier U2 is grounded through the resistor R4. The inverting terminal of the amplifier U2 is further connected to an output of the amplifier U2 through the resistor R5. The output of the amplifier U2 is further connected to a gate of the MOSFET Q. A drain of the MOSFET Q is connected to a node C between the resistors R1 and R2. A source of the MOSFET Q is grounded.

The processing circuit 60 includes a transformer (not marked), a rectifier circuit (not marked), and a three-terminal adjustable shunt reference source 65. The processing circuit 60 converts mains power supply to another alternating current (AC) power or to a direct current (DC) power. The three-terminal adjustable shunt reference source 65 is connected to the node C to make a voltage at the node C constant.

The processing circuit 60 supplies power to the electronic device 70 through the transmission line 50. The sense resistor Rs senses a sample current flowing through the transmission line 50. The sensed sample current is converted into a sample voltage. The sample voltage is amplified to an amplified voltage through the amplifiers U1 and U2. The amplified voltage is output to the gate of the MOSFET Q. The amplified voltage equals to a voltage difference Vgs between the gate and the source of the MOSFET Q.

In this embodiment, the voltage difference Vgs fulfills a formula: $Vgs>Vds-Vth$, where Vds stands for a voltage difference between the drain and the source of the MOSFET Q (namely a voltage at the node C), and Vth stands for a turn-on voltage of the MOSFET Q. As a result, the MOSFET Q works in a variable resistance region. According to the characteristics of the MOSFET transistor, when the MOSFET Q works in variable resistance region, an equivalent resistance between the drain and the source of the MOSFET Q changes with the voltage difference Vgs changing.

According to the circuit in the FIGURE, a current In flowed through the resistor R1 is equal to a sum of a current Ir2 flowing through the resistor R2 and a current Id flowing through the MOSFET Q. Because the voltage at the node C is constant, the current Ir2 is also unchanging, such that the current Ir1 increases when the current Id increases, and the current Ir1 decreases when the current Id decreases. As a result, a voltage at the output A increases when the current Id increases, or the voltage at the output A decreases when the current Id decreases.

When the current of the electronic device 70 increases, a voltage between two terminals of the transmission line 50 increases. At this time, the sample voltage sampled by the sense resistor Rs increases. The voltage difference Vgs increases. The equivalent resistance between the drain and the source of the MOSFET Q decreases. The current Id increases. As a result, the voltage at the output A increases. In this condition, when an incremental voltage at the output A is same as the incremental voltage between the two terminals of the transmission line 50, a voltage at the output B is constant. In other words, the electronic device 70 receives an unvarying and constant voltage.

When the current of the electronic device 70 decreases, the voltage between two terminals of the transmission line 50 decreases. At this time, the sample voltage sampled by the sense resistor Rs decreases. The voltage difference Vgs decreases. The equivalent resistance between the drain and the source of the MOSFET Q increases. The current Id decreases. As a result, the voltage at the output A decreases. In this condition, when a decreased voltage at the output A is same as the decreased voltage between the two terminals of the transmission line 50, the voltage at the output B is constant. In other words, the electronic device 70 receives an unvarying and constant voltage.

The foregoing description of the exemplary embodiments of the disclosure has been presented only for the purposes of illustration and description and is not intended to be exhaustive or to limit the disclosure to the precise forms disclosed. Many modifications and variations are possible in the light of everything above. The embodiments were chosen and described in order to explain the principles of the disclosure and their practical application so as to enable others of ordinary skill in the art to utilize the disclosure and various embodiments with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A power adapter, comprising:

a processing circuit converting mains power to another alternating current (AC) power or a direct current (DC) power;

a first output outputting the converted AC power or DC power;

a sense resistor connected between the processing circuit and the first output, for sampling a current flowing through the first output, and converting the sampled current to a sampled voltage;

an amplifying circuit connected to the sense resistor for amplifying the sampled voltage to an amplified voltage; and a metallic oxide semiconductor field effect transistor (MOSFET), wherein a gate of the MOSFET is connected to the amplifying circuit to receive the amplified voltage, a drain of the MOSFET is connected to the first output through a first resistor, the drain of the MOSFET is further grounded through a second resistor, a source of the MOSFET is grounded, a node between the first and second resistors is connected to the processing circuit; wherein the amplifying circuit makes the MOSFET work at variable resistance region.

2. The power adapter of claim 1, wherein when the MOSFET works at variable resistance region, the following condition is satisfied: $Vgs>Vds-Vth$, where Vgs stands for a voltage difference between the gate and the source of the MOSFET, Vds stands for a voltage difference between the drain and the source of the MOSFET, and Vth stands for a turn-on voltage of the MOSFET.

3. The power adapter of claim 1, further comprising:

a second output connected to an electronic device; and a transmission line connected between the first output and the second output.

4. The power adapter of claim 1, wherein the processing circuit comprises a three-terminal adjustable shunt reference source, the three-terminal adjustable shunt reference source is connected to the node between the first and second resistors to make a voltage at the node invariable.

5. The power adapter of claim 1, wherein the amplifying circuit comprises a first amplifier, a second amplifier, and third to fifth resistors; two terminals of the sense resistor are respectively connected to a non-inverting terminal and an inverting terminal of the first amplifier, an output of the first amplifier is connected to a non-inverting terminal of the second amplifier through the third resistor, an inverting terminal of the second amplifier is grounded through the fourth resistor, the inverting terminal of the second amplifier is further connected to an output of the second amplifier through the fifth resistor, the output of the second amplifier is further connected to the gate of the MOSFET.

* * * * *